US010197342B2

(12) United States Patent
Alahyari et al.

(10) Patent No.: US 10,197,342 B2
(45) Date of Patent: Feb. 5, 2019

(54) HEAT EXCHANGER SYSTEM AND METHOD OF OPERATION

(71) Applicant: HAMILTON SUNDSTRAND CORPORATION, Charlotte, NC (US)

(72) Inventors: Abbas A. Alahyari, Glastonbury, CT (US); Miad Yazdani, South Windsor, CT (US); Craig R. Walker, S. Glastonbury, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 29 days.

(21) Appl. No.: 15/631,657

(22) Filed: Jun. 23, 2017

(65) Prior Publication Data

US 2017/0370660 A1 Dec. 28, 2017

Related U.S. Application Data

(60) Provisional application No. 62/354,571, filed on Jun. 24, 2016.

(51) Int. Cl.
*F28F 13/04* (2006.01)
*F28F 13/16* (2006.01)
(Continued)

(52) U.S. Cl.
CPC ..... *F28F 13/04* (2013.01); *F28B 9/08* (2013.01); *F28D 1/04* (2013.01); *F28F 13/16* (2013.01);
(Continued)

(58) Field of Classification Search
CPC .. F28F 13/04; F28F 13/16; F28F 17/00; F28F 17/005; F28F 19/02; F28F 2245/00; F28F 2245/04; F25B 21/02
(Continued)

(56) References Cited

U.S. PATENT DOCUMENTS 4,211,276 A 7/1980 Itoh et al.
8,632,670 B2 * 1/2014 Garimella ..... F28F 13/16 204/450
2011/0303541 A1 12/2011 Garimella et al.

FOREIGN PATENT DOCUMENTS

DE 102012101980 A1 9/2013

OTHER PUBLICATIONS

English translation D102012101980.*
(Continued)

*Primary Examiner* — Jianying Atkisson
*Assistant Examiner* — Joel Attey
(74) *Attorney, Agent, or Firm* — Cantor Colburn LLP

(57) ABSTRACT

A method of operating a heat exchanger is disclosed in which an electric field is applied to a hydrophobic surface having condensed water droplets thereon to reduce a contact angle between the individual droplet surfaces and the hydrophobic surface, and to increase droplet surface energy to a second surface energy level. The electric field is removed to increase the contact angle between the individual droplet surfaces and the hydrophobic surface, and to reduce droplet surface energy to a third surface energy level. The third surface energy level is greater than the first surface energy level and greater than a surface energy level for a free droplet. A portion of the droplet surface energy is converted to kinetic energy to detach droplets from the hydrophobic surface. The detached droplets are removed from the heat rejection side fluid flow path.

6 Claims, 4 Drawing Sheets

(51) Int. Cl.

| | |
|---|---|
| ***F28B 9/08*** | (2006.01) |
| ***F25B 21/02*** | (2006.01) |
| ***F28F 17/00*** | (2006.01) |
| ***F28F 19/02*** | (2006.01) |
| ***F28F 27/00*** | (2006.01) |
| ***F28D 1/04*** | (2006.01) |

(52) U.S. Cl.
CPC ..... *F28F 17/00* (2013.01); *F28F 17/005* (2013.01); *F28F 19/02* (2013.01); *F28F 27/00* (2013.01); *F25B 21/02* (2013.01); *F28F 2245/00* (2013.01); *F28F 2245/04* (2013.01)

(58) Field of Classification Search
USPC ..... 165/231, 232
See application file for complete search history.

(56) References Cited

OTHER PUBLICATIONS

Hong, et al, "Detaching droplets in immiscible fluids from a solid substrate with the help of electrowetting," Lab Chip, The Royal Society of Chemistry, 2015, 15, pp. 900-907.
Search Report regarding related EP App. No. 171779693.0; dated Dec. 1, 2017; 10 pgs.
Tio, "Electrowetting Study of Jumping Droplets on Hydrophobic Surfaces"; Massachusetts Institute of Technology; Jun. 2014; 12 pgs.

* cited by examiner

HEAT EXCHANGER SYSTEM AND METHOD OF OPERATION

CROSS-REFERENCE TO RELATED APPLICATIONS

This patent application claims the benefit of priority to U.S. Provisional Patent Application Ser. No. 62/354,571, filed Jun. 24, 2016, which is incorporated herein by reference in its entirety.

BACKGROUND

The subject matter disclosed herein relates to heat exchangers and their operation, and more particularly to heat exchangers that are subject to condensate formation on heat transfer surfaces.

Heat exchangers are widely used in various applications, including but not limited to heating and cooling systems including fan coil units, heating and cooling in various industrial and chemical processes, heat recovery systems, and the like, to name a few. Many heat exchangers for transferring heat from one fluid to another fluid utilize one or more tubes through which one fluid flows while a second fluid flows around the tubes. Heat from one of the fluids is transferred to the other fluid by conduction through the tube walls. Many configurations also utilize fins in thermally conductive contact with the outside of the tube(s) to provide increased surface area across which heat can be transferred between the fluids, improve heat transfer characteristics of the second fluid flowing through the heat exchanger, and enhance structural rigidity of the heat exchanger.

One of the primary functions of a heat exchanger is to transfer heat from one fluid to another in an efficient manner. Higher levels of heat transfer efficiency allow for reductions in heat exchanger size, which can provide for reduced material and manufacturing cost, as well as providing enhancements to efficiency and design of systems that utilize heat exchangers such as refrigeration systems. However, there are a number of impediments to improving heat exchanger system efficiency. One such impediment is the formation of condensate on heat transfer surfaces. When condensate forms, it can adversely impact the efficiency heat transfer between a flowing gas and the heat transfer surfaces on which the condensate has formed. In some applications such as refrigeration, the condensate can freeze, which can further adversely impact efficiency. In salty environments such as maritime environments, the presence of condensate can also provide liquid water to form an electrolyte that can lead to galvanic corrosion of heat exchanger components

BRIEF DESCRIPTION

According to some embodiments of this disclosure, a method of operating a heat exchanger comprises rejecting heat from a gas comprising water vapor on a heat rejection side fluid flow path to a heat absorption side of the heat exchanger. Liquid droplets of condensed water are formed at a first surface energy level on a hydrophobic surface of the heat exchanger on the heat rejection side fluid flow path that is in thermal communication with the heat absorption side of the heat exchanger. An electric field is applied to the hydrophobic surface to reduce a contact angle between the individual droplet surfaces and the hydrophobic surface, and to increase droplet surface energy to a second surface energy level. The electric field is removed to increase the contact angle between the individual droplet surfaces and the hydrophobic surface, and to reduce droplet surface energy to a third surface energy level. The third surface energy level is greater than the first surface energy level and greater than a surface energy level for a free droplet. A portion of the droplet surface energy is converted to kinetic energy to detach droplets from the hydrophobic surface. The detached droplets are removed from the heat rejection side fluid flow path.

In some embodiments of the above method, fluid flow on the heat rejection side fluid flow path is maintained at a steady state flow velocity that entrains detached droplets.

In some embodiments of the above method, fluid flow on the heat rejection side fluid flow path is pulsed in timed coordination with removal of the electric field to provide a pulse flow velocity that entrains detached droplets.

In any one or combination of the foregoing embodiments, further comprising capturing contaminants from the gas into the droplets.

In any one or combination of the foregoing embodiments, the method further comprises applying an electric field to impart an electrostatic charge to the contaminants.

In any one or combination of the foregoing embodiments, the electric field is applied in response to detection of condensed water on the hydrophobic surface.

In any one or combination of the foregoing embodiments, the electric field is applied in response to a pressure differential between a heat rejection side fluid flow path inlet and outlet.

In any one or combination of the foregoing embodiments, the electric field is applied in response to a differential between a temperature of the hydrophobic surface and an ambient dew point temperature higher than the hydrophobic surface temperature.

In any one or combination of the foregoing embodiments, the electric field is pulsed in a cycle pattern comprising alternating on and off periods wherein the duration of the off period is equal to or longer than the duration of the on period.

In some embodiments, a heat exchanger system comprises a heat exchanger comprising a heat rejection side fluid flow path and a hydrophobic surface in thermal communication with a heat absorption side of the heat exchanger and in fluid communication with the heat rejection side flow path. The system also includes a power source and a controller configured to apply an electrical field to the hydrophobic surface to reduce a contact angle between condensate droplet surfaces and the hydrophobic surface and increase droplet surface energy to a second level greater than a first surface energy level for condensate droplets on the hydrophobic surface in the absence of an electric field. The controller and power source are further configured to remove the electric field to increase the contact angle between the individual droplet surfaces and the hydrophobic surface, and reduce droplet surface energy to a third surface energy level greater than the first surface energy level and greater than a surface energy level for a free droplet, and convert a portion of the droplet surface energy to kinetic energy to detach droplets from the hydrophobic surface.

In some embodiments, the controller of the above heat exchanger system is further configured to maintain fluid flow on the heat rejection side at a steady state flow velocity that entrains detached droplets.

In some embodiments, the controller of the above heat exchanger system is further configured to pulse fluid flow on the heat rejection side fluid flow in timed coordination with removal of the electric field to provide a pulse flow velocity that entrains detached droplets.

In any one or combination of the foregoing embodiments, the heat exchanger system controller is further configured to apply an electric field to impart an electrostatic charge to contaminants in the heat rejection side fluid flow path.

In any one or combination of the foregoing embodiments, the heat exchanger system controller is further configured to apply the electric field in response to a pressure differential between a heat rejection side fluid flow path inlet and outlet.

In any one or combination of the foregoing embodiments, the heat exchanger system controller is further configured to apply the electric field in response to a pressure differential between a heat rejection side fluid flow path inlet and outlet.

In any one or combination of the foregoing embodiments, the heat exchanger system controller is further configured to apply the electric field in response to a differential between a temperature of the hydrophobic surface and an ambient dew point temperature higher than the hydrophobic surface temperature In any one or combination of the foregoing embodiments, the heat exchanger system controller is further configured to apply the electric field in a pulsed cycle pattern comprising alternating on and off periods wherein the duration of the off period is equal to or longer than the duration of the on period.

In any one or combination of the foregoing embodiments, the hydrophobic surface is disposed on heat exchanger fins in thermal communication with the heat exchanger heat absorption side and in fluid communication with the heat rejection side fluid flow path.

In any one or combination of the foregoing embodiments, the heat exchanger fins individually comprise a portion comprising a hydrophilic surface.

In any one or combination of the foregoing embodiments, the hydrophobic surface comprises hydrophobic microstructural or nanostructural surface features.

In any one or combination of the foregoing embodiments, the hydrophobic surface comprises a hydrophobic coating disposed on a heat exchanger surface in thermal communication with the heat exchanger heat absorption side and in fluid communication with the heat rejection side fluid flow path.

In any one or combination of the foregoing embodiments, the heat exchanger hydrophobic surface comprises a heat exchanger structural feature formed from a hydrophobic polymer composition.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Figure 1:
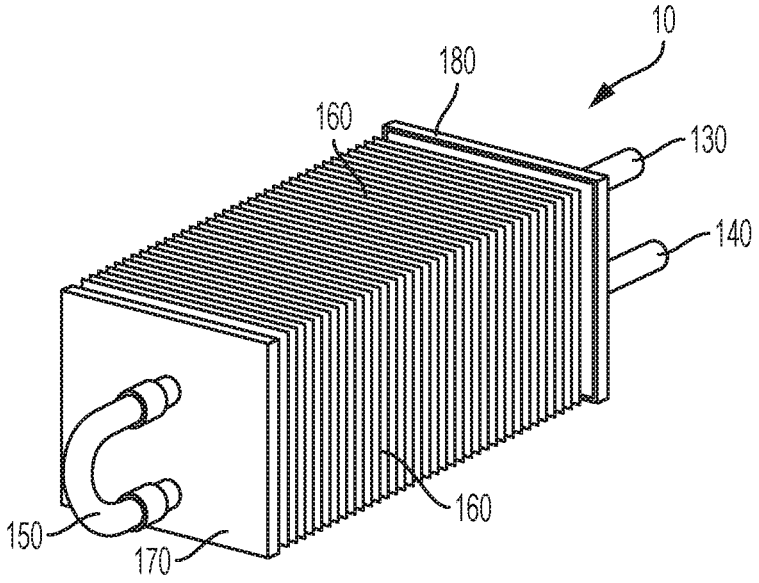
FIG. 1 is a schematic depiction of an example embodiment of a heat exchanger.

This disclosure can be applied to virtually any type of configuration of heat exchanger. An example embodiment of a round tube plate fin (RTPF) heat exchanger is schematically depicted shown in FIG. 1. As shown in FIG. 1, a heat exchanger 10 includes one or more flow circuits for carrying a heat transfer fluid such as a refrigerant. For the purposes of explanation, the heat exchanger 10 is shown with a single flow circuit refrigerant tube having an inlet line 130 and an outlet line 140 connected by tube bend 150. The inlet line 130 is connected to the outlet line 140 at one end of the heat exchanger 10 through a 180 degree tube bend 150. It should be evident, however, that more circuits may be added to the unit depending upon the demands of the system. For example, although tube bend 150 is shown as a separate component connecting two straight tube sections, the tube can also be formed as a single tube piece with a hairpin section therein for the tube bend 150, and multiple units of such hairpin tubes can be connected with u-shaped connectors at the open ends to form a continuous longer flow path in a 'back-and-forth' configuration. The heat exchanger 10 further includes a series of fins 160 comprising radially disposed plate-like elements spaced along the length of the flow circuit, typically connected to the tube(s) with an interference fit. The fins 160 are provided between a pair of end plates or tube sheets 170 and 180 and are supported by the lines 130, 140 in order to define a gas flow passage through which conditioned air passes over the refrigerant tube and between the spaced fins 160. Fins 160 may include heat transfer enhancement elements such as louvers or texture.

Figure 2:
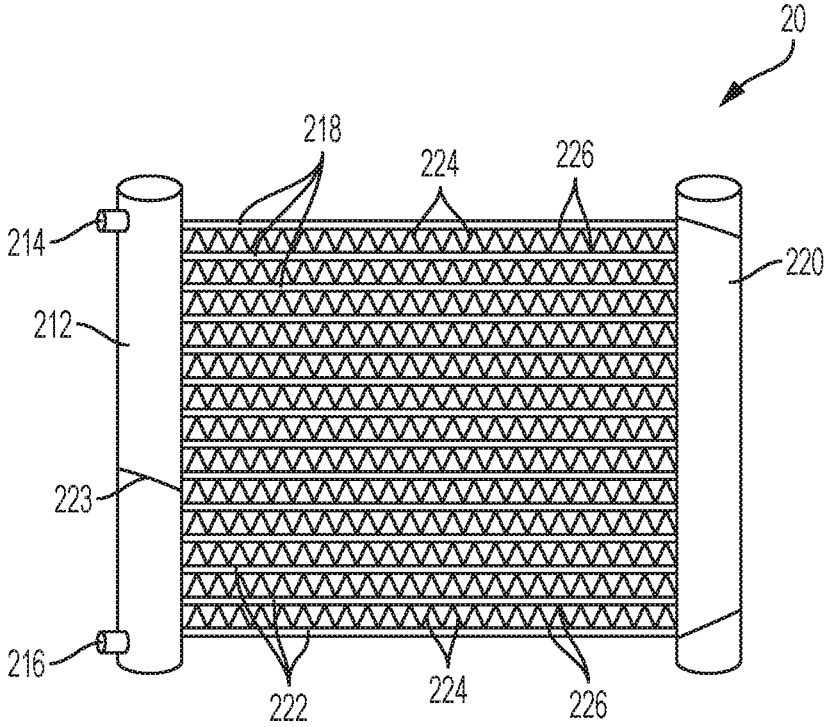
FIG. 2 is a schematic depiction of another example embodiment of a heat exchanger.

Another type of exemplary heat exchanger that can be used according to the embodiments described herein is a micro-channel or mini-channel heat exchanger. The configuration of these types of heat exchangers is generally the same, with the primary difference being rather loosely applied based on the size of heat transfer tube ports. For the sake of convenience, this type of heat exchanger will be referred to herein as a micro-channel heat exchanger. As shown in FIG. 2, a micro-channel heat exchanger 20 includes first manifold 212 having inlet 214 for receiving a working fluid, such as coolant, and outlet 216 for discharging the working fluid. First manifold 212 is fluidly connected to each of a plurality of tubes 218 that are each fluidly connected on an opposite end with second manifold 220. Second manifold 220 is fluidly connected with each of a plurality of tubes 222 that return the working fluid to first manifold 212 for discharge through outlet 216. Partition 223 is located within first manifold 212 to separate inlet and outlet sections of first manifold 212. Tubes 218 and 222 can include channels, such as microchannels, for conveying the working fluid. The two-pass working fluid flow configuration described above is only one of many possible design arrangements. Single and other multi-pass fluid flow configurations can be obtained by placing partitions 223, inlet 214 and outlet 216 at specific locations within first manifold 212 and second manifold 220. Fins 224 extend between tubes 218 and the tubes 222 as shown in the FIG. 2. Fins 224 support tubes 218 and tubes 222 and establish open flow channels between the tubes 218 and tubes 222 (e.g., for airflow) to provide additional heat transfer surfaces and enhance heat transfer characteristics. Fins 224 also provide support to the heat exchanger structure. Fins 224 are bonded to tubes 218 and 222 at brazed joints 226. Fins 224 are not limited to the triangular cross-sections shown in FIG. 2, as other fin configurations (e.g., rectangular, trapezoidal, oval, sinusoidal) can be used as well. Fins 224 may have louvers or texture to improve heat transfer.

In some embodiments, the a heat exchanger can be used to cool a gas comprising water vapor flowing on a heat rejection side of a heat exchanger such as the heat exchangers depicted in FIGS. 1 and 2. In some embodiments, the gas can flow along a heat rejection side flow path past the exterior of the tubes and between the fins 160 of FIG. 1, or through open flow channels between the tubes 218 and tubes 222 and along the surface of fins 224 of FIG. 2. Under some conditions such as when a heat transfer surface (e.g., tube exterior surface or fin surface) is at a temperature below the dew point of a flowing gas in fluid communication with (i.e., in contact with) the heat transfer surface.

Figure 3A:
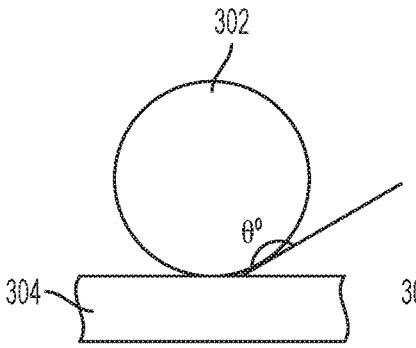
FIGS. 3A, 3B, 3C, 3D, and 3E each schematically represents a different stage of detachment of a water droplet from a substrate.
Figure 3B:
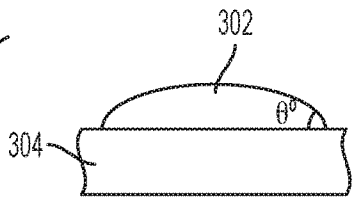

As stated above, condensed water droplets can be removed by selective application and removal of an electric field to change contact angles and surface energies of the droplets to cause them to detach from a hydrophic surface of the heat exchanger. An example water droplet 302 on a substrate 304 is schematically depicted in FIG. 3A. The surface tensions acting on a water droplet on a surface, which can be significantly larger than the force of gravity, are modeled by the Young equation:

$$\gamma_{SG}=\gamma_{SW}+\gamma_{WG}\cos\theta$$

where $\gamma_{SG}$ is the interfacial tension between the substrate and the gas, $\gamma_{SW}$ is the interfacial tension between the substrate and the water, $\gamma_{WG}$ is the interfacial tension between the water and the gas, and $\theta$ is the contact angle between the water droplet and the substrate. Application of an electric field reduces the contact angle according to the Young-Lippmann equation:

$$\cos\theta_E=(\gamma_{SG}-\gamma_{SW}+CV^2/2)/\gamma_{WG}$$

as shown in FIG. 3B where $\theta_E$ is the modified contact angle, V is the effective applied voltage (i.e., the integral of the electric field from the electrode to the water droplet) and C is the capacitance of a dielectric between the electrode and the water droplet.

The first surface energy of a water droplet on a substrate surface before application of the electric field can be characterized by the formula $$E_1=\gamma_{SW}[2\pi R(\theta_O)^2(1-\cos\theta_O)-\pi R(\theta_O)^2\cos\theta_O\sin^2\theta_O]$$

where $\theta_O$ is the contact angle of the droplet in the absence of the electrical field and R is the radius of the droplet configured as a spherical cap on the surface, which can be determined according by conservation of volume according to the formula $$\sqrt[3]{\frac{3V}{\pi(2-3\cos\theta+\cos^3\theta)}}$$

Application of the electric field to the water droplet reduces the contact angle as described above, and increases the surface energy according to the formula $$E_2=\gamma_{SW}[2\pi R(\theta_E)^2(1-\cos\theta_E)-\pi R(\theta_E)^2\cos\theta_O\sin^2\theta_E]$$

Figure 3C:
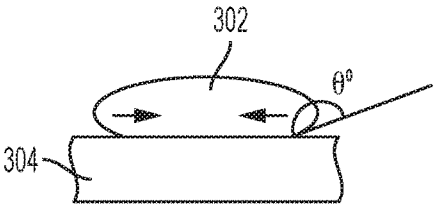

When the electric field is removed, the capacitor formed by the droplet and the electrode discharges much faster than the shape of the droplet can change. Accordingly, the shape of the droplet is still largely as in FIG. 3B, but contact angle reverts back to the original angle from prior to the application of the electric field as shown in FIG. 3C. The contribution to surface energy coming from the interface of the droplet with the substrate now changes with the contact angle according to the formula:

$$E_3=\gamma_{SW}[2\pi R(\theta)^2(1-\cos\theta)-\pi R(\theta)^2\cos\theta_O\sin^2\theta_E]$$

Figure 3D:
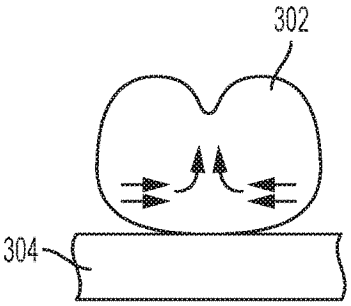
Figure 3E:
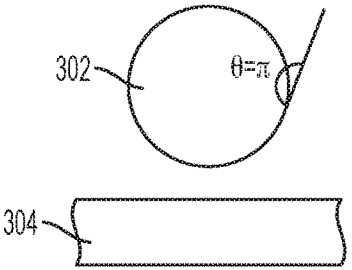

However, the droplet configuration in FIG. 3C is not stable, and the droplet enters a dynamic stage where a portion of the surface energy from the higher $E_3$ energy level is converted to kinetic energy as water begins to displace toward the center of the droplet as indicated by the arrows in FIG. 3C. As water continues to displace toward the center of the droplet, it collides with itself at the center. Displacement downward at that point is precluded by the substrate, so the kinetic energy is redirected upward away from the substrate as shown in FIG. 3D. In cases where the substrate is sufficiently hydrophobic, the substrate-water interfacial energy level $\gamma_{SW}$ can be such that $E_3$ is larger than the surface energy of a detached droplet, which can be characterized by the formula:

$$E_0=\gamma_{SW}4\pi R^2(\theta)$$

where $\theta$ (in radians) approaches the value for $\pi$. In this condition, the excited energy level $E_3$ provides sufficient energy to detach the droplet from the substrate as shown in FIG. 3E.

Figure 6:
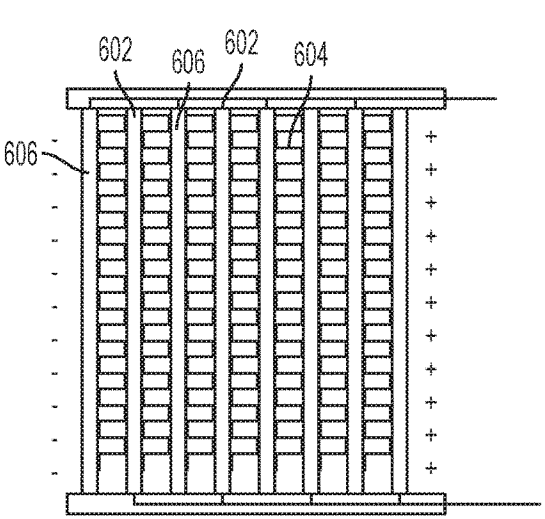
FIG. 6 is a schematic depiction of an example embodiment of a heat exchanger and electrode assembly.
Figure 5:
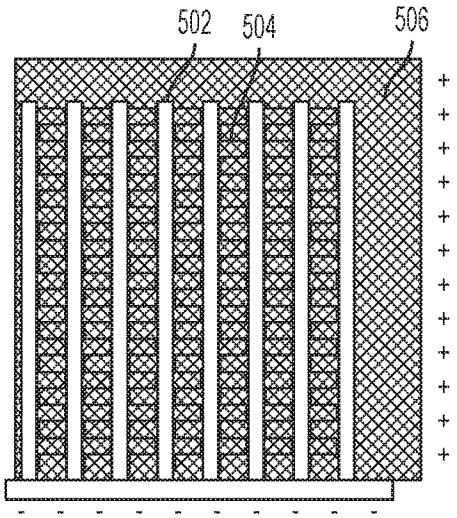
FIG. 5 is a schematic depiction of an example embodiment of a heat exchanger and electrode assembly.
Figure 4:
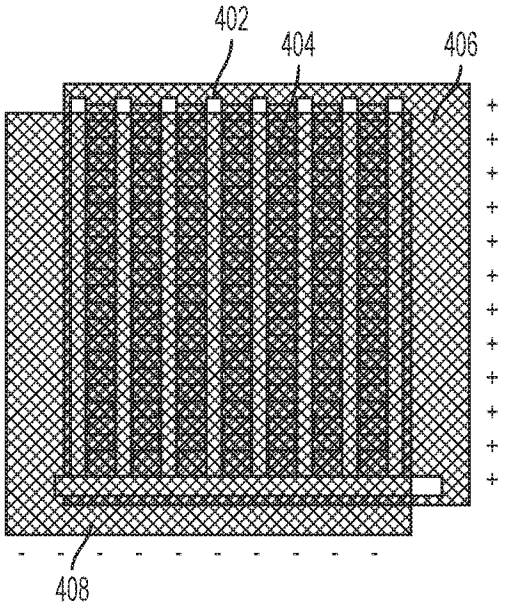
FIG. 4 is a schematic depiction of an example embodiment of a heat exchanger and electrode assembly.

Electrode conductors can be integrated into the heat exchanger system in a variety of configurations, a few non-limiting examples of which are schematically depicted in FIGS. 4-7. As shown in FIG. 4, a heat exchanger assembly comprising electrically conductive or non-conductive tubes 402 (e.g., aluminum tubes) and electrically conductive or non-conductive fins 404 (e.g., aluminum fins) is sandwiched between positively and negatively charged grids 406 and 408. As shown in FIG. 5, a heat exchanger assembly comprising electrically-conductive tubes 502 and electrically non-conductive fins 504 is disposed adjacent to a charged grid 506, which serves as one electrode, while the electrically-conductive tubes 502 serve as the other electrode. As shown in FIG. 6, electrically non-conductive fins 604 are disposed between positively-charged electrically-conductive tubes 602 (which serves as one electrode) and negatively-charged electrically-conductive tubes 606 (which serve as the other electrode). Electrically-non-conductive fins are utilized in FIGS. 5 and 6 to avoid short circuits. In other embodiments, the tubes can have an electrically non-conductive (but thermally-conductive) outer layer that to provide the necessary electrical isolation. Examples of electrically non-conductive thermally-conductive) materials for such a layer include but are not limited to various polymers such as polypropylene, polyphenylene sulfide, polyethylene, or liquid crystal polymers. These polymers may be filled with various filler material such as glass, graphite, boron nitride or carbon nanotubes or fibers to form composites with enhanced thermal conductivity. In still other embodiments, fin-less heat exchangers would not require such special considerations. A controller (not shown) can be configured to control electrical current from a power source (not shown) to selectively activate and deactivate the electrodes.

Figure 7:
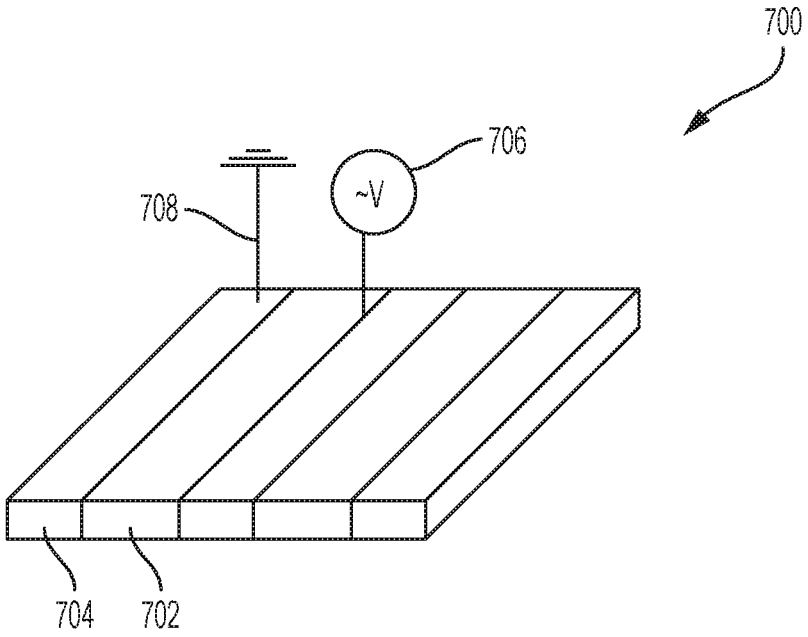
FIG. 7 is a schematic depiction of another electrode configuration for a heat exchanger surface.

In still other embodiments, electrodes can be integrated into a surface layer on the heat exchanger surface (e.g., a fin surface) as depicted in FIG. 7. Such surface layers can be utilized on polymer heat exchanger surfaces or on metal heat exchanger surfaces if isolated from the metal surface by an electrically non-conductive (but thermally-conductive) outer layer that provide the necessary electrical isolation. A heat exchanger top surface 700 is shown in FIG. 7, where electrically non-conductive hydrophobic sections 702 are disposed between electrically-conductive sections 704 that are charged to serve as electrodes as indicated by the schematic connections to power source 706 and ground 708. In some embodiments, the electrically-conductive sections 704 can be hydrophilic, providing a hydrophilic surface portion on the heat rejection side fluid flow path. Although this disclosure is not bound by any particular mechanism or theory of operation, it is believed that in some embodiments, the presence of a hydrophilic portion can inhibit recapture of the water droplets onto the hydrophobic surface after detachment, which can in some embodiments promote a condensate-free hydrophobic surface for efficient heat transfer.

As can be appreciated from the above discussion, selection of a substrate having a target hydrophobicity is important for achieving detachment of water droplets from the substrate by applying and removing an electric field. Hydrophobicity can be achieved through various materials and material configurations for the substrate. In some embodiments, the substrate can be formed from a chemically hydrophic material or can comprise a surface layer formed from a chemically hydrophobic material. Chemically hydrophobic materials typically comprise nonpolar molecular structures that are incapable of forming hydrogen bonds with water. Introduction of such a non-hydrogen bonding surface to water causes disruption of the hydrogen bonding network between water molecules. The hydrogen bonds are reoriented tangentially to such surface to minimize disruption of the hydrogen bonded 3D network of water molecules and minimize the water-hydrophobe interfacial surface area. Examples of chemically hydrophobic materials include but are not limited to polyethylene, polypropylene, or polytetrafluoroethylene (PTFE). Hydrophobicity can also be provided through surface coating such as polyurethane or other hydrophobic coatings or by micro- or nano-sized features on the substrate surface. In some embodiments, the surface has hierarchical surface roughness with nanoscale or microscale structural or roughness features imparting a hydrophobic or superhydrophobic property to the surface. In some non-limiting examples, the microscale roughness may have Ra surface roughness values ranging from approximately 5 microns to approximately 100 microns and the nanoscale roughness may have an Ra value ranging from approximately 250 nanometers to approximately 750 nanometers. Surface roughness can be provided by chemical etching, spray coating, or sintering. In some embodiments, the heat rejection side fluid flow path heat exchanger surface can be formed from a chemically hydrophobic material or have a chemically hydrophobic surface coating, and have microscale or nanoscale surface features. In some embodiments, the surface can have microscale or nanoscale surface features and be formed from a hydrophilic material to provide hydrophilic sections such as sections 704 of FIG. 7, and can have portions of the surface coated with a chemically hydrophobic material to provide hydrophobic sections such as sections 702 of FIG. 7.

Droplets ejected from the hydrophobic surface as described above are removed from the heat rejection side fluid flow path. This can be accomplished by providing a flow velocity on the heat rejection side fluid flow path that entrains the detached droplets so that they can be carried out of the flow path along with the flowing gas. In some embodiments, the flow velocity is maintained at a steady state velocity that entrains the detached droplets. In some embodiments, the flow velocity is pulsed in timed coordination with the removal of the electric field to provide a temporary higher pulsed flow velocity to entrain the detached droplets. In some embodiments, contaminants can be captured in the water droplets and removed from the heat exchanger surface along with the detached water droplets. This can occur based on the surface tension interaction between the contaminants and the water droplets or, in some embodiments, the above-described electrodes, or separate electrodes disposed upstream along the gas flow path upstream of hydrophobic surface (either on the heat rejection side fluid flow path or upstream of the heat rejection side fluid flow path) can be used to apply an electric field to impart an electrostatic charge to the contaminants to facilitate their capture by the water droplets.

Various process control criteria can be utilized to trigger application and removal of the electric field to remove water droplets from the heat exchanger surface. In some embodiments, the electric field can be applied in response to detection of water on the hydrophobic surface (e.g., by a moisture sensor). In some embodiments, the the electric field can be applied in response to a pressure differential (e.g., measured by pressure sensors) between a heat rejection side fluid flow path inlet and outlet, as the pressure drop differential can be indicative of accumulation of water on heat exchanger surfaces such as on closely-spaced fins. In some embodiments, the electric field can be applied in response to a differential between a temperature of the hydrophobic surface (e.g, measured by a temperature sensor either at the surface or measured for a working fluid on a heat absorption side fluid flow path) and an ambient dew point temperature (e.g., measured by a humidity sensor disposed at a heat rejection side fluid flow path inlet). In some embodiments, the electric field can be pulsed in a cycle pattern comprising alternating on and off periods. In some embodiments, the cycles are symmetrical with the duration of the off periods being equal to the duration of the on periods. In some embodiments, the duration of the off periods is greater than the duration of the on periods. Various waveforms can be used for cycling the electric field, including but not limited to square waves, saw waves, sinusoidal waves.

[from template] The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of operating a heat exchanger, comprising rejecting heat from a gas comprising water vapor on a heat rejection side fluid flow path to a heat absorption side of the heat exchanger to form liquid droplets of condensed water at a first surface energy level on a hydrophobic surface of the heat exchanger on the heat rejection side fluid flow path that is in thermal communication with the heat absorption side of the heat exchanger;

applying an electric field to the hydrophobic surface to reduce a contact angle between the individual droplets surfaces and the hydrophobic surface and increase droplets surface energy to a second surface energy level; and removing the electric field to increase the contact angle between the individual droplets surfaces and the hydrophobic surface, and reduce droplets surface energy to a third surface energy level greater than the first surface energy level and greater than a surface energy level for a free droplets, converting a portion of the droplets surface energy to kinetic energy to detach droplets from the hydrophobic surface; and removing detached droplets from the heat rejection side fluid flow path, wherein fluid flow on the heat rejection side fluid flow path is pulsed in timed coordination with removal of the electric field to provide a pulse flow velocity that entrains detached droplets, or contaminants from the gas are captured into the droplets by applying an electrostatic charge to the contaminants, or the method includes measuring a pressure differential between a heat rejection side fluid flow path inlet and outlet and applying the electric field in response to the measured pressure differential, or the method includes measuring a temperature differential between a temperature of the hydrophobic surface and an ambient dew point temperature higher than the hydrophobic surface temperature and applying the electric field in response to the measured temperature differential.

2. The method of claim 1, wherein fluid flow on the heat rejection side fluid flow path is pulsed in timed coordination with removal of the electric field to provide a pulse flow velocity that entrains detached droplets.

3. The method of claim 1, wherein contaminants from the gas are captured into the droplets and an electric field is applied to impart an electrostatic charge to the contaminants.

4. The method of claim 1, wherein the electric field is applied in response to a pressure differential between a heat rejection side fluid flow path inlet and outlet.

5. The method of claim 1, wherein the electric field is applied in response to a differential between a temperature of the hydrophobic surface and an ambient dew point temperature higher than the hydrophobic surface temperature.

6. The method of claim 1, wherein the electric field is pulsed in a cycle pattern comprising alternating on and off periods wherein the duration of the off period is equal to or longer than the duration of the on period.

* * * * *